United States Patent [19]

Beimgraben

[11] Patent Number: 5,050,692

[45] **Date of Patent: * Sep. 24, 1991**

[54] METHOD FOR DIRECTIONAL DRILLING OF SUBTERRANEAN WELLS

[75] Inventor: Herbert W. Beimgraben, Houston, Tex.

[73] Assignee: Baker Hughes Incorporated, Houston, Tex.

[ * ] Notice: The portion of the term of this patent subsequent to Apr. 4, 2006 has been disclaimed.

[21] Appl. No.: 285,081

[22] Filed: Dec. 16, 1988

Related U.S. Application Data

[63] Continuation-in-part of Ser. No. 83,520, Aug. 7, 1987, Pat. No. 4,817,740.

[51] Int. Cl.[5] ..... E21B 7/08

[52] U.S. Cl. ..... 175/61; 175/74; 175/76; 175/256

[58] Field of Search ..... 175/73, 74, 76, 61, 175/256, 325, 320

[56] References Cited

U.S. PATENT DOCUMENTS

| | | | |
|---|---|---|---|
| 3,586,116 | 6/1971 | Tiraspolsky | 175/256 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,560,013 | 12/1985 | Beimgraben | 175/73 |
| 4,577,701 | 3/1986 | Dellinger et al. | 175/61 |
| 4,667,751 | 5/1987 | Geczy et al. | 175/61 |
| 4,694,914 | 9/1987 | Obrecht | 175/61 |
| 4,739,842 | 4/1988 | Kruger et al. | 175/61 |

FOREIGN PATENT DOCUMENTS

| | | | |
|---|---|---|---|
| 0287155 | 10/1988 | European Pat. Off. | 175/61 |

*Primary Examiner*—Bruce M. Kisliuk

*Attorney, Agent, or Firm*—Hubbard, Thurman, Turner & Tucker

[57] ABSTRACT

A method for directional drilling of a well with a motor and drill bit. A tubular housing is secured to the lower end of the motor with the housing having a first surface with an axis angularly disposed relative to the axis of the tubular housing. A second tubular housing has a surface engagable with the first surface and is angularly disposed relative to the axis of the second tubular housing with the extent of the engagement of the first and second surfaces determining the angular position of the axis of the second tubular housing relative to the axis of the first tubular housing. The extent of the engagment of the surfaces is selectively adjustable by shims. A first angular stabilizer is carried with a drill bit which is rotatably mounted with a drive means including universal joints. The apparatus is secured to a tubing string with a drill bit and lowered into the bore hole with the apparatus actuated by application of tubing weight with direction being controlled by rotation of the drill string.

5 Claims, 1 Drawing Sheet

METHOD FOR DIRECTIONAL DRILLING OF SUBTERRANEAN WELLS

CROSS-REFERENCE TO RELATED APPLICATIONS

This application is a continuation-in-part application to co-pending application Ser. No 083,520 filed Aug. 7, 1987, entitled "Apparatus for Directional Drilling of Subterranean Wells" and assigned to the same assignee as the present application.

BACKGROUND OF THE INVENTION

1. Field of the Invention

The invention relates to a method for utilizing a mechanism which can be incorporated in a drill string for effecting a change in direction of a rotary drill bit relative to the existing bore of a subterranean well.

2. Description of the Prior Art

The changing of the direction of drilling of the bore of a subterranean well is an expedient long practiced by well drillers. In many instances the change in direction is to produce a straightening of the well due to the deflection of the rotary drill from the desired direction by a particular rock strata. In other instances, the change in direction is intentional in order to reach a formation that is laterally displaced from the existing location of the bore hole.

One of the most common expedients for changing the direction of drilling has been the insertion in the drilling or work string, at a point above a downhole motor which drives the rotary drill bit, an apparatus which is called a bent sub. Such bent subs are rigidly connected at one end to the work string and have their other connecting end angularly disposed connected, so that when the motor and supported drill bit are rigidly supported thereby, the rotational axis of the drill bit will be angularly inclined relative to the axis of the well bore existing prior to insertion of the bent sub.

Because the change in angle has heretofore been accomplished at a substantial distance above the rotary drill bit, particularly with the class of fluid motors known as turbines, which by design are relatively long, a large degree of interference is created between the bent sub and the rotary drill bit and the well bore wall as the work string is lowered in the hole to where the drilling would again begin. Additionally, to effect a desired change in drilling angle, which generally is on the order of a fraction of a degree, it was necessary to remove the motor and drill bit from the end of the work string and insert a particular bent sub which had the desired angular deviation incorporated therein. This required the maintenance at the drilling site of an inventory of bent subs having different deviation angles.

U.S. Pat. No. 4,522,272 discloses a bent housing for incorporation in a drilling string which is adjustable to provide a range of angular positions of the rotary drill relative to the axis of the drilling string.

A lesser known method for changing the direction of drilling, but an effective one, particularly with the aforementioned long turbine motors has been the incorporation of an eccentric stabilizer on the lower end of said turbines. This method is well documented by a presentation at the 1979 Drilling Technology Conference, Denver, Col. in a paper titled "Turbo-Drilling Deviated Holes in Abu Dhabi" and a more recent article published in the October, 1982 issue of Journal of Petroleum Technology entitled "Kicking Off In Large Diameter Holes". This method has removed some of the interference problems of the bent sub but has required a large inventory of fixed, offset axis stabilizers, and has not addressed the problem of easily changing the amount of offset of the stabilizer depending on the current drilling and rig conditions.

There was therefore a recognized need in the well drilling industry for an apparatus which will permit a selected change in the drilling direction to be effected without the large degree of interference mentioned above, and secondarily, without having to maintain a large inventory of fixed offset stabilizers.

U.S Pat. No. 4,560,013 provides an adjustable eccentric stabilizer mounted intermediate the motor housing and the rotating drilling bit for effecting a change in the direction of the drilling bit primarily by transversely shifting the rotational axis of the drilling bit. Such apparatus has been highly successful in drilling wells through a large variety of formations, but, as is well known in the art, directional drilling depends upon two primary factors: (1) the amount of interference with the side wall of the previously drilled bore developed by transversely shifting the axis of rotation of the rotary drilling tool or (2) a change in the angular direction of the axis of rotation of the drilling bit so that the face of the drilling bit proceeds in a different direction than the axis of the previously drilled portion of the well bore. A number of papers have been written on the subject and the general consensus is that for certain types of formations and hole sizes, directional change produced by side wall interference of the drilling bit with the bore wall is quite effective, while for other types of formations and other sizes of bores, better results are achieved by angularly changing the axis of rotation of the drilling bit.

The prior art has not heretofore provided a rotary drilling tool which can be adjusted to effect directional changes either by side wall interference or by changing the angular position of the axis of rotation of the rotary drilling tool, or through a combination of such adjustments.

U.S. Pat. No. 4,492,276 is directed to a directional drilling method utilizing a particular downhole angularly disposed mud motor system. In our parent application, U.S. Ser. No. 083,520, we disclosed and claimed unique directional drilling eccentrically disposed mud motor system which can be utilized in a method of drilling a well wherein weight is applied on the bit continuously during selective movements of the drill bit through the well while maintaining the axis of rotation of the drill bit at an angle to the axis of rotation of the housing of the apparatus at all times to effect satisfactory directional drilling of a borehole in a well having both straight and deviated sections to be drilled therethrough.

SUMMARY OF THE INVENTION

The invention provides a method for use of a rotary drilling tool comprising an elongated tubular motor housing which is conventionally connected at its lower end to a universal housing. The universal housing is provided with threads on its lower end having an axis which is angularly disposed relative to the axis of the motor housing. A bearing housing, having similarly angularly displaced threads is threadably engaged with the universal housing and the extent of threaded bearing housing and the extent of axial displacement of the periphery of the stabilizer is controlled by the interposition of a selected number of shims between adjacent ends of the interengaging threaded sections of the bearing housing and the annular eccentric stabilizer.

A rotary drilling tool is then conventionally mounted for rotation about the axis of the bore of the bearing housing. Such drilling tool is driven by the fluid pressure motor contained in the motor housing through a conventional drive shaft connection, including a universal joint. The universal joint accommodates both angular and lateral deviations of the axis of the rotary drilling tool with respect to the axis of the motor housing.

In accordance with a modification of this invention, an additional annular eccentric stabilizer element is mounted on the upper end of the motor housing and this unit is also adjustable in its degree of eccentricity with respect to the axis of the motor housing through the interposition of a selected number of shims between the adjacent ends of the two eccentrically disposed threaded sections respectively provided on the motor housing, or a housing secured thereto, and on the annular eccentric stabilizer.

With the aforedescribed construction, the lateral deviation of the axis of the rotary drilling tool relative to the axis of the previously drilled well bore may be shifted by any selected amount, consistent with the subsequent insertion of the drilling tool through the entire well bore. At the same time, or independently of the lateral deviation of the axis of the rotary drilling tool, the inclination of the axis of the rotary drilling tool relative to the axis of the previously drilled well bore may be selectively changed so that the drilling can proceed in a new direction through the combined effects of lateral interference of the drilling tool with the previously drilled bore wall and by the shift in angular direction of the face of the rotary drilling tool.

In the present invention, the rotary drilling tool may be used in a method for directional drilling of the borehole by connecting a drill bit which is inclined to the axis of the housing of the apparatus and connecting the apparatus to the lower end of a drill string. The drill string, apparatus and drill bit are lowered into the borehole. Thereafter, the apparatus is continuously driven and weight is applied through the drill string to the bit during the drilling operation. The apparatus is directed within the borehole while weight is continuously applied on the drill bit by rotating the drill string when straight hole is desired to be drilled and the drill bit encounters such straight hole portion of a subterranean well and by not rotating the drill string at such times as the drill bit and drill string encountered curved or deviated sections of the well, in such event the axis of the rotation of the bit is maintained at an angle to the axis of rotation of the apparatus.

Further objects and advantages of the invention will be readily apparent to those skilled in the art from the following detailed description, taken in conjunction with the annexed sheets of drawings, on which are shown several preferred embodiments of the invention.

DESCRIPTION OF PREFERRED EMBODIMENTS

Figure 1:
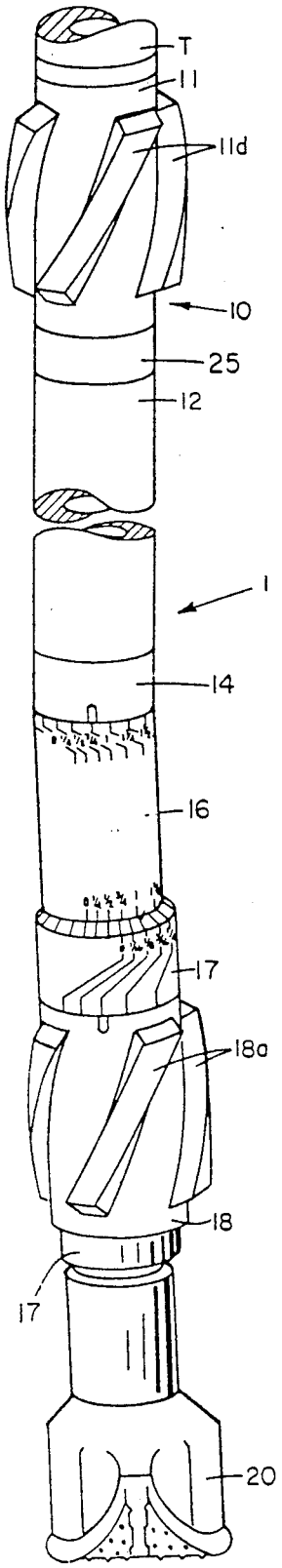
FIG. 1 is a perspective view of a well drilling tool embodying this invention.

Referring to FIG. 1, there is shown an adjustable bent, eccentrically stabilized drilling tool 1 embodying this invention. Such tool comprises an upper stabilizing housing 10 having helically disposed well bore contacting centralizing ribs 11*d* mounted on its periphery. Housing 10 is secured to the top of a motor housing 12 which, at its bottom end, is secured to a universal housing 14, which in turn is connected at its bottom end to intermediate housing 16. Intermediate housing 16 is in turn secured to bearing housing 17 that has a lower annular eccentric stabilizer 18 mounted on its periphery and carrying helical ribs 18*a*. The lower end of bearing housing 17 rotatably mounts a rotary drilling bit 20. Thus, as indicated in FIG. 2, a drive shaft 22 connects the output of the fluid pressure motor 13 with the rotary drill bit 20 through two universal units 24 guided by bearing 23.

Figure 2:
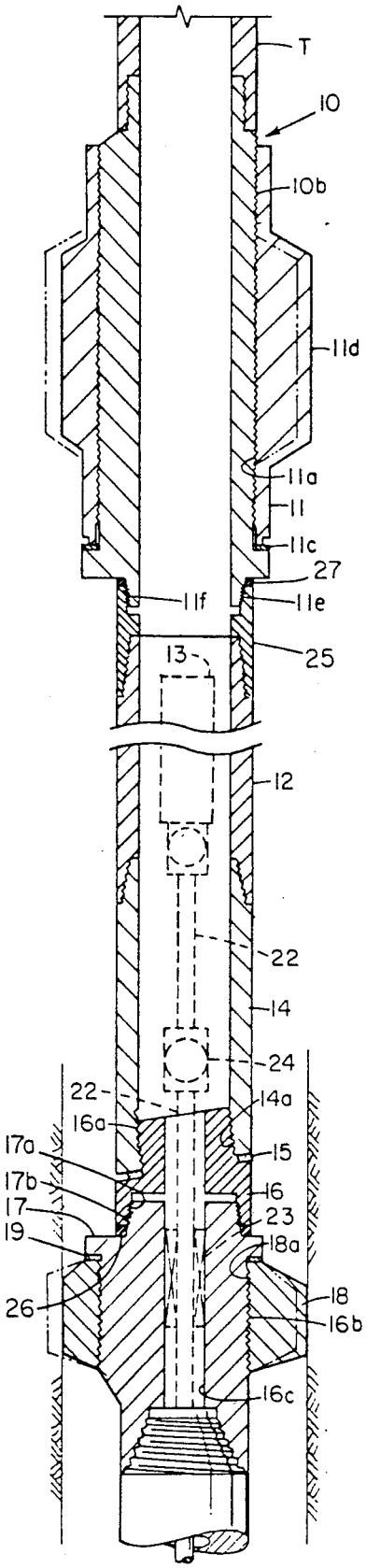
FIG. 2 is a vertical sectional view of the tool of FIG. 1 showing only the elements of the well drilling tool which control the direction of drilling, with the drilling motor, universal joint, drive shaft and bearings being schematically indicated by dotted lines. In this Figure the tool is drilling a straight hole.
Figure 3:
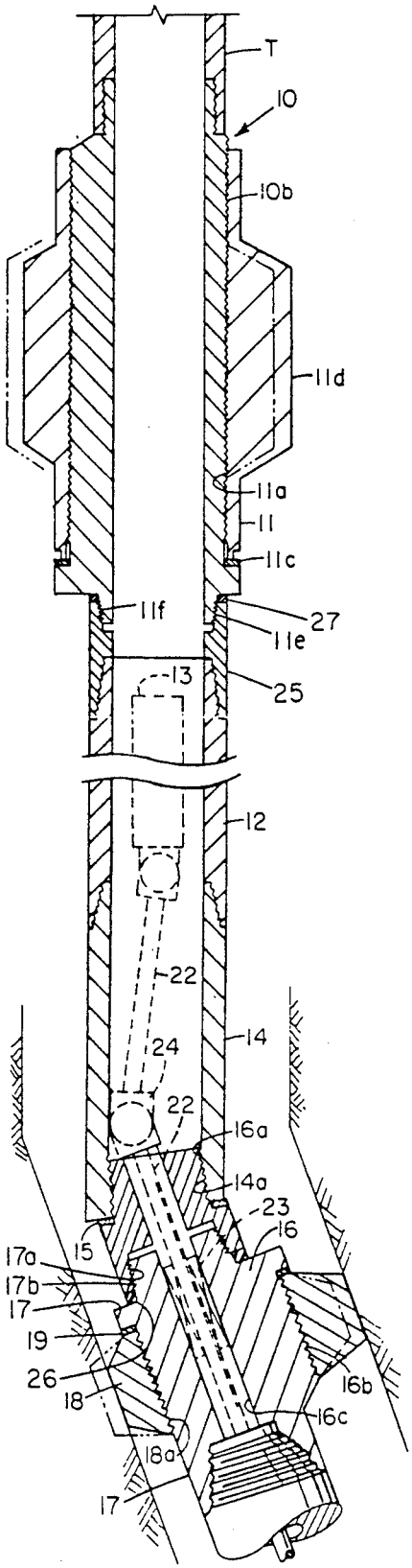
FIG. 3 is a view similar to FIG. 2 but illustrating the position of the directional adjusting components of the well drilling tool to effect an extreme change in direction of drilling.

Referring now to FIGS. 2 and 3, the threaded interconnections of the above enumerated components are shown in detail so that the capability for angular adjustment of the axis of drilling tool 20 as well as for adjustment of the lateral offset thereof from the previously formed bore hole may be clearly understood.

The upper eccentric stabilizer 10 is constructed in substantially the same manner as the eccentric stabilizer shown in the aforementioned U.S. Pat. No. 4,560,013. Thus, the upper eccentric stabilizer 10 is provided with a threaded external surface 10*b* which is eccentric with respect to the bore axis of the stabilizer 10. An annular eccentric 11 has internal threads 11*a* cooperating with the external threads 10*b* and the degree of eccentricity of the annular eccentric 11 is determined by selectively inserting a desired number of shims 11*c* between the bottom end of the internal threads 11*a* and the adjacent bottom end of the external threads 10*b*. The helical ribs 11*d* are integrally formed on the periphery of eccentric stabilizer 11. Thus, the upper eccentric stabilizer 10 is capable of being adjusted between the position of concentricity relative to the bore of the tool as shown in solid lines to the other extreme eccentric position shown in dotted lines. Of course other magnitudes of eccentricity relative to the bore of the tool may be obtained by adjustment to a position intermediate the two extreme laterally offset positions.

Eccentric housing 10 is provided at its lower end with external threads 11*e* which cooperate with internal threads formed on the top portion of the intermediate housing 25. Intermediate housing 25 is provided with threads of its lower end which cooperate with the motor housing 12. The motor 13, indicated in dotted lines, is conventionally mounted within motor housing 12 and is of the fluid pressure type, being driven by fluid pressure supplied to the motor housing 12 by a tubing string T conventionally connected to the top of the upper eccentric stabilizer 10 and extending to the well surface.

A universal housing 14 is provided with a conventional threaded connection to the bottom end of the motor housing 12. The universal housing 14 has angularly inclined internal bottom threads 14*a* which cooperate with similarly angularly inclined external threads 16*a* formed on a bearing housing 16. The angular inclination of such threads is greatly exaggerated for clarity of illustration. A selected number of shims 15 are disposed between the adjacent threaded ends of the internal threads 14*a* and the external threads 16*a* to permit the degree of angularity of the intermediate housing 16 relative to the axis of the universal housing 14 to be conveniently selected by insertion of the required number of shims. In FIG. 2, the intermediate housing 16 is positioned in an axially aligned position with universal housing 14, while in FIG. 2, an extreme angular position of intermediate housing 16 is illustrated. The intermediate housing 16 is provided with internal threads 17*a* which cooperate with similar external threads 17*b* formed on bearing housing 17.

The bearing housing 17 is provided with an eccentric, stabilizer 18 is threadably secured to the threads 16*b* by internal threads 18*a*. The desired degree of offset of the lower eccentric stabilizer 18 is obtained by the insertion of a selected number of shims 19 between the adjacent ends of external threads 16*b* and internal threads 18*a*. Thus, the lower eccentric stabilizer is selectively adjustable between one extreme laterally offset position indicated by the full lines in FIGS. 1 and 2 and another extreme offset position indicated by the dotted lines in FIGS. 2 and 3. Selective alignment of the desired lateral offset with the aforementioned axially aligned position of intermediate housing 16 relative to universal housing 14 is obtained by the insertion of a selected number of shims 26 between the adjacent threaded internal threads 17*a* and external threads 17*b*.

The bore 16*c* of the bearing housing 16 provides conventional mounting for bearings 23 effecting the rotational mounting of the drilling tool 20 and, as previously mentioned, drilling tool 20 is connected to the shaft 22 of motor 12 by universal joints 24.

The degree of angular deflection accomplished by the angularly inclined threads 14*a* and 16*a* is conveniently indicated on the exterior of the tool by scribe lines and numerals as shown in FIG. 1. A second set of scribe lines and numerals may also be provided on the exterior of the tool to indicate the lateral displacement of the lower eccentric stabilizer 19. Likewise, a third set of scribe lines may be provided on the exterior of the tool to indicate the degree of alignment of the angular deflection and lateral displacement. Similar scribe lines and numerals may be provided for the upper stabilizer 11 if desired, but in many applications of the aforedescribed tool, it is unnecessary to incorporate the upper stabilizer 11.

With the aforedescribed construction, an angular adjustment of the rotational axis of the rotating drilling tool 20 may be accomplished by adjustment of the stabilizer 18 relative to the universal housing 14. Such adjustment changes the attack angle of the drilling tool without effecting any significant change in the interference between the drilling tool and the previously drilled bore, Conversely, the amount of lateral offset of the rotating drilling tool 20 with respect to the axis of the motor housing 12 can be conveniently adjusted by the setting of the lower eccentric stabilizer 18 or the upper eccentric stabilizer 11, or both. In every case, due to the utilization of shims between the threaded arts, the adjustable parts may be tightly threaded together in their newly adjusted positions without danger of separation of such parts during subsequent operations.

With the apparatus positioned on a drill string above a drill bit, the string, apparatus and drill bit are lowered into the hole which is expected to encounter at least one or more series of straight and deviated portions of the well. The motor apparatus of the present invention is continuously actuated and weight is applied through the drill string onto the bit. The apparatus is directed within the earth formation as weight is applied to it by means of rotation of the drill string and during selected periods of deviated hole drilling the drill string is not rotated and the axis of rotation of the bit is maintained to the angle of the axis of rotation of the housing of the apparatus, continuously.

Although the invention has been described in terms of specified embodiments which are set forth in detail, it should be understood that this is by illustration only and that the invention is not necessarily limited thereto, since alternative embodiments and cooperating techniques will become apparent to those skilled in the art in view of the disclosure. Accordingly, modifications are contemplated which can be made without departing from the spirit of the described invention.

What is claimed and desired to be secured by Letters Patent is:

1. Method for positioning a motor driven drilling bit relative to a well bore to control the direction of further drilling during directional and deviated drilling operations of a subterranean well, comprising the steps of:

securing to a drill string an apparatus comprising a drill bit and, thereabove, a downhole motor having a housing supportable on the drill string and mounting a fluid motor driven by pressurized fluid supplied through the drill string;

a first tubular housing having an upper end concentrically secured to the lower end of said motor housing;

the lower end of said first tubular housing having a first surface form thereon having an axis angularly disposed relative to the axis of the first tubular housing;

a second tubular housing having a second surface engagable with the first surface;

said second surface being angularly disposed relative to the axis of said second tubular housing, whereby the extent of engagement of the first and second surfaces determines the angular position of the axis of said second tubular housing relative to the axis of the first tubular housing;

means for selectively adjusting the extent of engagement of said first and second surfaces comprising a threaded connection between said surfaces and a selected number of shims inserted between the adjacent ends of said first and second surfaces;

a third tubular housing concentrically secured to the lower end of said second tubular housing;

the third tubular housing having an external surface that is eccentric relative to the bore axis of said third tubular housing;

first angular stabilizer means rotationally adjustably mounted on said external surface;

the first angular stabilizer having an external cylindrical surface that is eccentric relative to the external surface, whereby the lateral position of the first angular stabilizer may be selectively adjusted;

means for rotatably mounting a drilling bit on the third tubular housing;

drive means including universal joints, traversing the bores of the first, second and third tubular housings to operatively connect the fluid motor and the drill bit, and a second adjustable eccentric stabilizer secured to the exterior of the upper end of the motor housing;

continuously actuating the fluid motor through said universal joints and applying a predeterminable weight on the drill bit;

manipulating the apparatus within the well while weight is applied on the bit and the motor is actuated by rotating the drill string when the apparatus encounters straight portions, the drill string not being rotated when said drill string and said apparatus encounter deviated portions of said well, the axis of rotation of the bit being maintained at an angle to the axis of rotation of the housing during all phases of said directional drilling.

2. A method of directing an apparatus for positioning a motor driven drilling bit relative to a well bore to control the direction of further drilling, said apparatus comprising:

a downhole motor housing supportable on a tubing string and mounting fluid motor driven by pressurized fluid supplied through the tubing string;

a first tubular housing having an upper end concentrically secured to the lower end of said motor housing;

the lower end of said first tubular housing having first surface formed thereon having an axis angularly disposed relative to the axis of said first tubular housing;

a second tubular housing having second surface engagable with said first surface;

said second surface being angularly disposed relative to the axis of said second tubular housing, whereby the extent of engagement of said first and second surfaces determines the angular position of the axis of said second tubular housing relative to the axis of said first tubular housing;

means for selectively adjusting the extent of engagement of said first and second surfaces;

a third tubular housing concentrically secured to the lower end of said second tubular housing;

said third tubular housing having an external surface that is eccentric relative to the bore axis of said third tubular housing;

first annular stabilizer means rotationally adjustably mounted on said external surface;

said first annular stabilizer having an external cylindrical surface that is eccentric relative to said external surface, whereby the lateral position of said first annular stabilizer may be selectively adjusted;

means for rotatably mounting a drilling bit on said third tubular housing;

drive means, including universal joints, traversing the bores of said first, second and third tubular housings to operatively connect said fluid motor and said drilling bit; and a second adjustable eccentric stabilizer secured to the exterior of the upper end of said motor housing;

comprising the steps of:

(a) manipulating the tubing string to position the eccentricity in said apparatus and the bit in the direction said well bore should be drilled;

(b) activating said fluid motor while keeping the tubing string stationary when it is desired to drill along a deviated position in the well bore as determined by the eccentricity angle and first concentric annular stabilizer; and (c) rotationally manipulating the tubing string and the fluid motor and the drill bit while the fluid motor is activated to turn the bit when it is desired to drill along a non-deviated portion of said well bore.

3. Method for positioning a motor driven drilling bit relative to a well bore to control the direction of further drilling during directional and deviated drilling operations of a subterranean well, comprising the steps of:

(1) securing to a drill string an apparatus comprising a drill bit and, thereabove, a downhole motor having a first tubular housing supportable on the drill string and mounting a fluid motor driven by pressurized fluid supplied through the drill string;

the lower end of said first tubular housing having a first surface form thereon having an axis angularly disposed relative to the axis of the first tubular housing;

a second tubular housing having a second surface engagable with the first surface;

said second surface being angularly disposed relative to the axis of said second tubular housing, whereby the extent of engagement of the first and second surfaces determines the angular position of the axis of said second tubular housing relative to the axis of the first tubular housing;

means for selectively adjusting the extent of engagement of said first and second surfaces comprising a threaded connection between said surfaces and a selected number of shims inserted between adjacent ends of said first and second surfaces;

a third tubular housing concentrically secured to the lower end of said second tubular housing, the third tubular housing having an external surface that is eccentric relative to the bore is of said third tubular housing;

means for rotatably mounting a drilling bit on the third tubular housing;

drive means including universal joints, transversing the bores of the first, second nd third tubular housings to operatively connect the fluid motor and the drill bit;

an annular eccentric stabilizer means rotationally adjustably mounted on said external surface, the annular stabilizer having an external cylindrical surface that is eccentric relative to the external surface, whereby the lateral position of the annular stabilizer may be selectively adjusted;

(2) continuously actuating the fluid motor through said universal joints and applying a predeterminable weight on the drill bit;

(3) manipulating the apparatus within the well while weight is applied on the bit and the motor is actuated by rotating the drill string when the motor encounters straight portions, the drill string not being rotated when said drill string an said motor encounter deviated portions of said well, the axis of rotation of the bit being manipulated at an angle to the axis of rotation of the housing during all phases of said deviated drilling; and (4) manipulating the motor within the well while weight is applied on the bit and the motor is actuated by rotating the drill string when the motor encounters portions straighter or angled slightly increasing relative to vertical, the drill string not being rotated when said drill string and said motor encounter deviated portions of said well, the axis of rotation of the bit being maintained at an angle to the axis of rotation of the housing during all phases of said deviated drilling.

4. Method for positioning a motor driven drilling bit relative to a well bore o control the direction of further drilling during directional and deviated drilling operations of a subterranean well, comprising the steps of:

(1) securing to a drill string an apparatus comprising a drill bit and, thereabove, a downhole motor having a first tubular housing supportable on the drill string and mounting a fluid motor driven by pressurized fluid supplied through the drill string;

the lower end of said first tubular housing having a first surface form thereon having an axis angularly disposed relative to the axis of the first tubular housing;

a second tubular housing having a second surface engagable with the first surface;

said second surface being angularly disposed relative to the axis of said second tubular housing, whereby the extent of engagement of the first and second surfaces determines the angular position of the axis of said second tubular housing relative to the axis of the first tubular housing;

means for selectively adjusting the extent of engagement of said first and second surfaces comprising a threaded connection between said surfaces and a selected number of shims inserted between adjacent ends of said first and second surfaces;

a third tubular housing concentrically secured to the lower end of said second tubular housing, the third tubular housing having an external surface that is eccentric relative to the bore axis of said third tubular housing;

means for rotatably mounting a drilling bit on the third tubular housing;

drive means including universal joints, transversing the bores of the first, second, and third tubular housings to operatively connect the fluid motor and the drill bit;

an annular eccentric stabilizer means rotationally adjustably mounted on said external surface, the annular stabilizer having an external cylindrical surface that is eccentric relative to the external surface, whereby the lateral position of the annular stabilizer may be selectively adjusted;

a second adjustable eccentric stabilizer secured to the exterior of the upper end of said first tubular motor housing;

(2) continuously actuating the fluid motor through said universal joints and applying a predeterminable weight on the drill bit;

(3) manipulating the apparatus within the well while weight is applied on the bit and the motor is actuated by rotating the drill string when the motor encounters straight portions, the drill string not being rotated when said drill string and said motor encounter deviated portions of said well, the axis of rotation of the bit being manipulated at an angle to the axis of rotation of the housing during all phases of said deviated drilling; and (4) manipulating the motor within the well while weight is applied on the bit and the motor is actuated by rotating the drill string when the motor encounters straight portions, the drill not being rotated when said drill string and said motor encounter deviated portions of said well, the axis of rotation of the bit being maintained at an angle to the axis of rotation of the housing during all phases of said deviated drilling.

5. Method for positioning a motor driven drilling bit relative to a well bore to control the direction of further drilling during directional and deviated drilling operations of a subterranean well, comprising the steps of:

(1) securing to a drill string an apparatus comprising a drill bit and, thereabove, a downhole motor having a first tubular housing supportable on the drill string and mounting a fluid motor driven by pressurized fluid supplied through the drill string;

the lower end of said first tubular housing having a first surface form thereon having an axis angularly disposed relative to the axis of the first tubular housing;

a second tubular housing having a second surface engagable with the first surface;

said second surface being angularly disposed relative to the axis of said second tubular housing, whereby the extent of engagement o the first and second surfaces determines the angular position of the axis of said second tubular housing relative to the axis of the first tubular housing;

means for selectively adjusting the extent of engagement of said first and second surfaces comprising a threaded connection between said surfaces and a selected number of shims inserted between adjacent ends of said first and second surfaces;

means for rotatably mounting a drilling bit on the second tubular housing;

drive means including universal joints, transversing the bores o the first and second tubular housings to operatively connect the fluid motor and the drill bit;

an annular stabilizer rotationally mounted to the exterior of the upper end of the first tubular motor housing;

(2) continuously actuating the fluid motor through said universal joints and applying a predeterminable weight on the drill bit;

(3) manipulating the apparatus within the well while weight is applied on the bit and the motor is actuated by rotating the drill string when the motor encounters straight portions, the drill string not being rotated when said drill string and said motor encounter deviated portions of said well, the axis of rotation of the bit being manipulated at an angle to the axis of rotation of the housing during all phases of said deviated drilling; and (4) manipulating the motor within the well while weight is applied on the bit and the motor is actuated by rotating the drill string when the motor encounters potions straighter or angles slightly decreasing relative to vertical, the drill string not being rotated when said drill string and said motor encounter deviated portions of said ell, the is of rotation of the bit being maintained at an angle to the axis of rotation of the housing during all phases of said deviated drilling.

* * * * *